United States Patent [19]

Grössler

[11] 4,425,850

[45] Jan. 17, 1984

[54] DEVICE FOR INITIATING AN EXPLOSIVE CHARGE WITH DAMMING MEANS OF NON-EXPLOSIVE SHOCK WAVE ATTENUATING MATERIAL BETWEEN THE OUTER BOOSTER AND THE LINER

[75] Inventor: Peter Grössler, Hochstadt, Fed. Rep. of Germany

[73] Assignee: Messerschmitt-Bölkow-Blohm G.m.b.H., Fed. Rep. of Germany

[21] Appl. No.: 261,705

[22] Filed: May 8, 1981

[30] Foreign Application Priority Data

May 24, 1980 [DE] Fed. Rep. of Germany ..... 3019948

[51] Int. Cl.[3] ..... F42B 1/00

[52] U.S. Cl. ..... 102/307; 102/309; 102/331; 102/332; 102/476

[58] Field of Search ..... 102/307–310, 102/331, 332, 476

[56] References Cited

U.S. PATENT DOCUMENTS

| | | | |
|---|---|---|---|
| 2,684,030 | 7/1954 | Muskat et al. | 102/307 |
| 2,873,676 | 2/1959 | Caldwell | 102/310 X |
| 2,935,020 | 5/1960 | Howard et al. | 102/310 X |
| 2,947,250 | 8/1960 | Mohaupt | 102/310 X |
| 3,053,182 | 9/1962 | Christopher | 102/307 X |
| 3,057,295 | 10/1962 | Christopher | 102/307 X |
| 3,215,074 | 11/1965 | Robinson, Jr. et al. | 102/308 X |
| 3,233,688 | 2/1966 | Bell | 102/307 X |
| 4,184,430 | 1/1980 | Mock | 102/307 X |
| 4,253,523 | 3/1981 | Ibsen | 102/310 X |

*Primary Examiner*—Peter A. Nelson

*Attorney, Agent, or Firm*—McGlew and Tuttle

[57] ABSTRACT

An explosive device is disclosed which comprises a cylindrical casing filled with explosive charge. The charge is covered at one or both of its sides by a fragmentable lining which is fragmented by explosion of the explosive charge and movement of the shock wave in an effective direction. A recess is provided in the explosive charge which contains an inner booster charge surrounded by an outer annular booster charge. The inner and outer booster charges may be separated by a thin wall with openings in the wall communicating with spaced in the recess on sides of the outer booster charge. A damming lining covers a part of the outer booster charge and is spaced from the outer booster charge to form the spaces.

18 Claims, 2 Drawing Figures

DEVICE FOR INITIATING AN EXPLOSIVE CHARGE WITH DAMMING MEANS OF NON-EXPLOSIVE SHOCK WAVE ATTENUATING MATERIAL BETWEEN THE OUTER BOOSTER AND THE LINER

FIELD AND BACKGROUND OF THE INVENTION

The present invention relates in general to the construction of explosive charges and, in particular, to a new and useful device for initiating an explosive charge which utilizes a central charge booster surrounded by an outer charge booster which extends into the main charge body.

In devices of this kind, known from German OS 27 10 612 for example, the booster charge is positioned to initiate the detonation of the explosive charge concentrically. The explosive charge may be a rotationally symmetrical hollow body having its front side covered with a centrally extending lining which is intended to form piercing fragments or stings. As known, it is important, for the target destroying effect of such a hollow charge, that the detonation wave hit the lining or coating forming the piercing projectile fragments or stings at as steep an angle as possible, preferably at a right angle, since this accelerates the fragments to speeds which are substantially higher than speeds which may be achieved with a skirting detonation wave. In addition, such accelerations are obtained in a substantially shorter time. To obtain such a favorable direction of the detonation wave, conventional designs provide bodies of inert material embedded in the explosive charge between the area of initiation and the top of the lining or coating to be fragmented, or, alternatively they provide specially oriented and located cavities in the respective part of the explosive charge (German OS 27 06 060).

SUMMARY OF THE INVENTION

The present invention is directed to an improvement of the above-mentioned devices, which ensures, in a simple and inexpensive way, that hitherto employed conventional means for orienting the detonation wave are no longer needed to obtain a large surface initiation in the peripheral zone of explosive charges of this kind.

Accordingly, an object of the present invention is to provide an explosive device which includes an explosive charge having a recess therein, the explosive charge shaped to have an effective direction and to fragment a fragmental lining into particles, in the effective direction, an inner booster charge near the center of the recess and an outer booster charge around the inner booster charge and extending into the explosive charge, the outer booster charge being covered at least partly by a shock wave attenuating inert and non explosive damming lining.

Another object of the present invention is to provide such a device wherein a thin wall separates the inner booster charge from the outer booster charge.

Another object of the invention is to provide a space between the damming lining and the outer booster charge with openings in the thin wall separation between the inner and outer booster charge communicating with the space.

Another object of the invention is to provide a device for initiating or igniting an explosive charge in a manner to apply substantially normal force to the fragmentable lining.

A still further object of the invention is to provide an explosive device which is simple in design, rugged in construction and economical to manufacture.

In accordance with the invention, the positioning of the two booster charges relative to each other and to the explosive charge, in connection with the inexpensive damming, makes sure that if the inner booster charge is initiated centrally by means of the detonator, the detonation wave passes unhindered first crosswise to the predetermined effective direction of the explosive charge and symmetrically through the inner and outer booster charges up to the adjacent peripheral zone of the explosive charge, and therefrom symmetrically through the explosive charge in the predetermined effective direction.

If the explosive charge is provided on one or both front sides with a lining or coating to be fragmented into stings, the detonation wave hits the lining or coating symmetrically at a right angle.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following, two embodiments of the invention are described in more detail with reference to the drawings in which.

DESCRIPTION OF THE PREFERRED EMBODIMENTS

Figure 1:
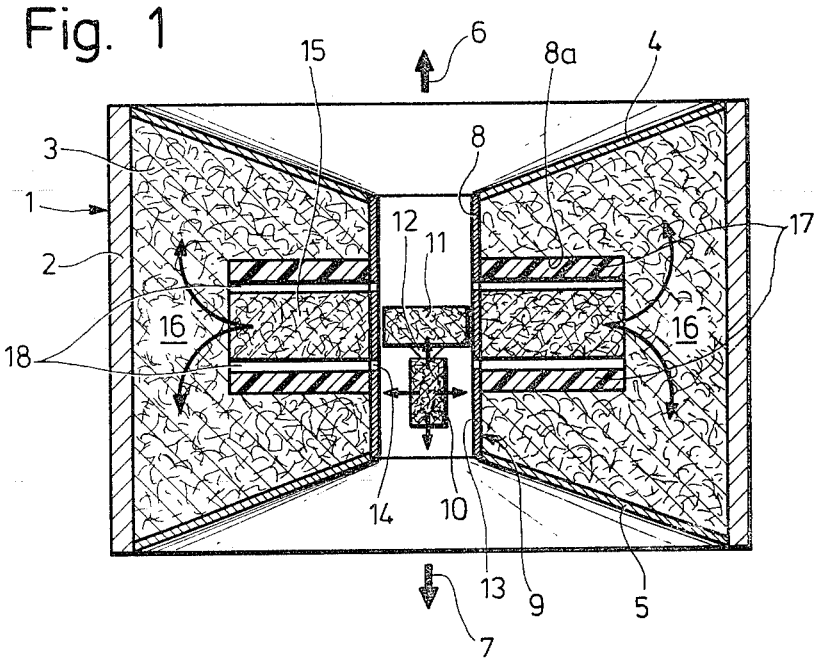
FIG. 1 is a longitudinal sectional view of an armor-piercing mine.

Referring to the drawings in particular the invention embodied therein, in FIG. 1, shows an antitank mine 1.

The mine comprises a cylindrical case 2 accommodating an explosive charge 3. Charge 3 is provided on its both front sides with coatings or linings 4, 5 intended to be fragmented into piercing particles or stings to be projected in the direction of arrows 6 and 7. The mine is formed with a central through hole 8 of circular cross section, which is enlarged in the middle zone between the two coatings 4 and 5 to a coaxial annular cavity 8*a*. Central hole 8 receives a fuse casing 9. Accommodated in casing 9 are a detonator 10 and a booster charge 11. Detonator 10 is movable from a safe position (not shown) to the shown armed position, preferably by pivoting or shifting. Booster charge 11 has the shape of a circular solid disc which may be formed, on the side facing the detonator, with a conical or frustoconical extension 12 intended for obtaining an exactly centrical initiation or ignition of the charge 11. Booster charge 11 is disposed centrally in fuse casing 9, between the two coatings 4 and 5 to be fragmented, and occupies at the respective location the entire cross section area of the fuse casing. Casing 9 has a relatively thin wall which is provided, close to the zone of booster charge 11, with flow ports 14 forming passages from central hole 8 to cavity 8*a*. Cavity 8*a* accommodates an annular booster charge 15 disposed concentrically of booster charge 11.

Transversely to the effective directions 6 and 7, both cavity 8a and booster charge 15 extend into the peripheral zone 16 of the explosive charge.

To prevent the explosive charge 3 from being initiated prematurely in the zones adjacent the surfaces extending transversely to the effective direction 6 and 7 of booster charge 15, circular discs 17 of an inert, shock-wave attentuating material such as plastic or other synthetic material, are provided as damming means at those surfaces, with a gap 18 communicating with flow ports 14 in wall 13 of fuse casing 9 being left between each disc 17 and booster charge 15.

Figure 2:
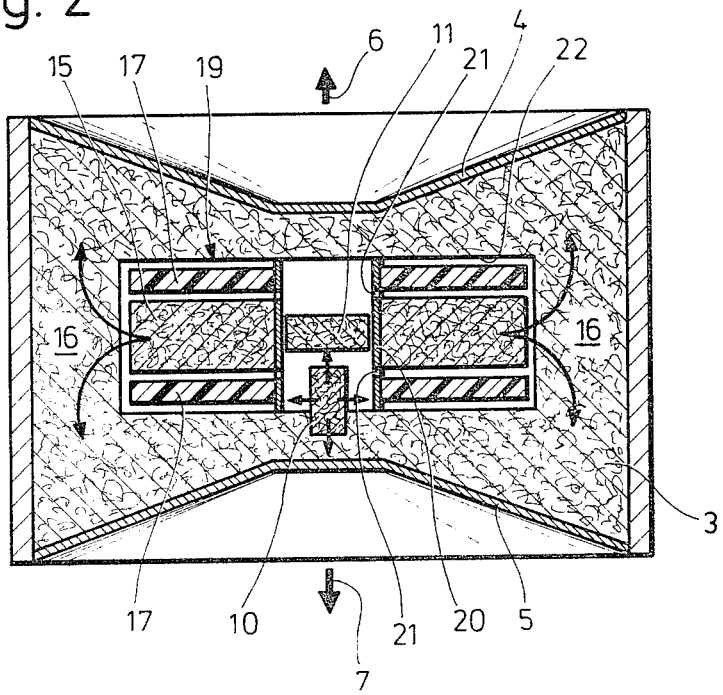
FIG. 2 is a similar view of another embodiment having the same purpose.

In a modification of the design of FIG. 1, the embodiment of FIG. 2 provides that both the outer booster charge 15 with its damming disc 17 and inner booster charge 11 as well as detonator 10 are accommodated in a fuse casing 19 having a disc-shaped outline. The disc 17 either has a constant thickness or becomes narrower toward the outside of the charge 3 as with the embodiment of FIG. 1. In this design, again a relatively thin wall 20 with flow ports 21 is provided between the inner booster charge 11 and the outer booster charge 15, which, however, does not reach up to the front side coatings 4 and 5 to be fragmented, as was the case in FIG. 1. The cavity provided in explosive charge 3 and equi-distantly spaced from the coatings, is designated 22 in this embodiment, and receives the disc shaped fuse casing 19, and also extends into the peripheral zone 16 of the explosive charge, transversely to the effective directions 6 and 7 as was the case also in FIG. 1.

In both embodiments described in the foregoing, upon an initiation by detonator 10, the detonation wave first passes symmetrically and unhindered through inner booster charge 11 and thin outer booster charge 15 to the peripheral zone 16 of the explosive charge, in the direction of arrows 23, and therefrom in the direction of arrows 24 and 25 to the front side coatings 4 and 5 to be fragmented. Consequently, the coatings are hit by the detonation wave at a right angle which results in a particularly powerful projection of the piercing fragments or stings.

While specific embodiments of the invention have been shown and described in detail to illustrate the application of the principles of the invention, it will be understood that the invention may be embodied otherwise without departing from such principles.

I claim:

1. An explosive device comprising:

a case in the form of a body of rotation about a central axis and defining an open face;

an explosive charge in the case;

at least one fragmentable lining covering the open face and the explosive charge, the explosive charge shaped to explode and fragment the lining substantially in an effective direction parallel to the central axis;

the explosive charge having a recess therein symmetrical about the axis and extending in the explosive charge and symmetrical about a central vector of the effective direction;

an inner booster charge substantially at a center of the recess;

an outer booster charge positioned around the inner booster charge and extending into the recess; and damming means covering at least a portion of the outer booster charge made of non-explosive shock-wave attenuating material and between the outer booster and the liner.

2. A device according to claim 1, wherein said case includes two fragmentable linings one on either side of the explosive charge, said recess positioned between said linings and having the shape of a body of rotation extending in the explosive charge.

3. A device according to claim 2, wherein said recess includes a central bore extending through said explosive charge and said fragmentable linings, and an annular portion extending outwardly into said explosive charge substantially from the middle of said bore.

4. A device according to claim 3, wherein said damming means comprises first and second disc shaped damming linings positioned above and below said outer annular charge and spaced from said outer annular charge.

5. A device according to claim 4, including a thin wall separating tube between said inner and outer booster charges.

6. A device according to claim 5, wherein said tube includes openings communicating with the spaces between said disc members and said outer booster charge.

7. A device according to claim 2, wherein said linings are conically shaped and extend inwardly toward each other.

8. A device according to claim 1, including a thin wall separation between said inner and outer booster charges.

9. A device according to claim 1, including a detonator movable toward said inner booster charge.

10. A device according to claim 9, wherein said inner booster charge includes a substantially frustoconical extension extending toward said detonator.

11. A device for initiating an explosive charge with a predetermined effective direction, particularly a charge provided with at least one lining which forms piercing fragments to be projected, comprising, a first booster charge ignitable by means of a detonator, a second outer concentric booster charge, the two booster charges being received within a recess provided in the explosive charge which is symmetrical in the predetermined effective direction of the explosive charge, and disposed in positions coaxial with an axis of symmetry of the recess, with the recess and the outer booster charge extending into a peripheral zone of the explosive charge in a direction transverse to the predetermined effective direction, and a damming lining over the surface of the outer booster charge and in the recess extending transversely to the predetermined effective direction made of an inert non explosive material.

12. A device according to claim 11, wherein the explosive charge is and has bi-directional lining on either side thereof of the explosive charge and the two booster charges being located in the middle of the explosive charge between the two side linings.

13. A device according to claim 11, wherein the first booster charge is formed on its side facing the detonator with a transfer centering element in the shape of a cone.

14. A device according to claim 11, including a tube having a relatively thin wall provided between the first booster charge and the outer booster charge.

15. A device according to claim 14, wherein the tube wall is provided with apertures in the zone of the two booster charges.

16. A device according to claim 11, wherein the thickness of the damming lining of the outer booster charge is constant throughout.

17. A device according to claim 11, wherein the thickness of the damming lining of the outer booster charge diminishes in the direction transverse to the effective direction of the explosive charge, from the interior to the exterior of the explosive charge.

18. A device according to claim 15, wherein clearances communicating with the apertures in the tube wall are provided between the outer booster charge and the damming lining.

* * * * *